US006470918B1

(12) United States Patent
Ghiardo et al.

(10) Patent No.: US 6,470,918 B1
(45) Date of Patent: Oct. 29, 2002

(54) YARN PROCESSING SYSTEM

(75) Inventors: Fiorenzo Ghiardo, Pettinengo (IT); Lars Helge Gottfrid Tholander, Haverdal (SE)

(73) Assignee: Iro Patent AG, Baar (CH)

( * ) Notice: Subject to any disclaimer, the term of this patent is extended or adjusted under 35 U.S.C. 154(b) by 0 days.

(21) Appl. No.: 09/787,044

(22) PCT Filed: Sep. 13, 1999

(86) PCT No.: PCT/EP99/06765

§ 371 (c)(1),
(2), (4) Date: Jun. 11, 2001

(87) PCT Pub. No.: WO00/15533

PCT Pub. Date: Mar. 23, 2000

(30) Foreign Application Priority Data

Sep. 11, 1998 (DE) ..... 198 41 699

(51) Int. Cl.[7] ..... D03D 47/34; B65H 51/22; D03J 1/04

(52) U.S. Cl. ..... 139/452; 310/48

(58) Field of Search ..... 310/48; 139/452

(56) References Cited

U.S. PATENT DOCUMENTS

| | | | | |
|---|---|---|---|---|
| 3,774,860 A | | 11/1973 | Loepfe | |
| 4,143,289 A | | 3/1979 | Williams | |
| 4,226,379 A | | 10/1980 | Brouser et al. | |
| 4,715,411 A | | 12/1987 | VanBogaert et al. | |
| 5,069,395 A | | 12/1991 | Krumm | |
| 5,385,310 A | | 1/1995 | Tholander | |
| 5,520,732 A | | 5/1996 | Sarfati | |
| 5,613,528 A | * | 3/1997 | Zenoni et al. | 139/452 |
| 5,662,148 A | * | 9/1997 | Jacobsson et al. | 139/452 |

FOREIGN PATENT DOCUMENTS

| | | |
|---|---|---|
| DE | 4240711 A1 | 6/1994 |
| EP | 0396902 A1 | 11/1990 |
| EP | 0619262 A1 | 10/1994 |
| EP | 0767385 A1 | 4/1997 |
| WO | WO 90/07600 | 7/1990 |

* cited by examiner

*Primary Examiner*—John J. Calvert
*Assistant Examiner*—Robert H. Muromoto, Jr.
(74) *Attorney, Agent, or Firm*—Flynn, Thiel, Boutell & Tanis, P.C.

(57) ABSTRACT

A yarn processing system which includes a yarn feeding device and an accessory device associated with the yarn feeding device. The accessory device has a device which is driven using a signal representing the rotational speed of a component of the yarn feeding device. The signal is generated by an electronic sensor galvanically separated from the control system and the drive mechanism of the yarn feeding device. The sensor also is structurally independent from the yarn feeding device. The sensor is located at or close to the yarn feeding device at a mounting location where a part of a rotating magnetic field is detected by the sensor at the mounting location. The part of the magnetic field originating from inside of the yarn feeding device is not used for the operation of the yarn feeding device at the mounting location of the sensor.

20 Claims, 1 Drawing Sheet

YARN PROCESSING SYSTEM

FIELD OF THE INVENTION

The present invention relates to a yarn processing system, as well as to an electronic sensor for a yarn feeding device.

BACKGROUND OF THE INVENTION

In a yarn processing system as known from EP 06 19 262 A and DE 44 14 870A, respectively, the accessory device processing the yarn is a yarn oiler mounted with a carrier means to the inlet side end wall of the housing of the yarn feeding device. The yarn oiler includes a control unit for an electric drive motor driving a treatment element by which an impregnation substance like wax or oil is applied onto the yarn. The rotational speed of the treatment element is related to the rotational speed of a component in the yarn feeding device, and as such indirectly to the yarn speed. Said component is conveying the yarn within the yarn feeding device and is driven by an electric motor and in a controlled fashion. The yarn feeding device is prepared with its control system and its housing design for a functional and structural controlled co-action with the yarn oiler. A cable, preferably with a detachable connector, extends from the control system of the yarn feeding device through and out of the housing of the yarn feeding device to the control unit of the yarn oiler and is transmitting a signal by galvanic conduction, which signal represents the rotational speed in the yarn feeding device. This accordingly necessitates a structural preparation of the yarn feeding device for the co-action with the yarn oiler and excludes the usage per se of the yarn oiler with other yarn feeding devices having no such corresponding preparation. The prerequisites are similar for the other such accessory devices like controlled yarn brakes, slip conveyors or rotational drives for storage bobbins from which the yarn feeding device is pulling off the yarn, because all of said accessory devices also need said rotation speed signal for the co-action with the yarn feeding device. In case that the yarn feeding device is used without the accessory device, the costly preparation of its control system and its housing is superfluous. In addition, the provided galvanic connection for the speed signal transmission might undesirably influence the control of the yarn feeding device in case of a disturbance at the side of the accessory device or along the signal transmission path.

It is a task of the invention to provide a yarn processing system of the kind as disclosed above as well as an electronic sensor which are able to avoid a preparation of the yarn feeding device in terms of its control system and/or its design, in view of a co-action with any kind of such speed depending controlled driven accessory device, and which furthermore allow one to easily use any speed depending driven accessory device at different types of yarn feeding devices, and wherein the danger of a disturbing influence of the accessory device with respect to the control system of the yarn feeding device is avoided.

Since the sensor according to the invention is galvanically separated and independent from the yarn feeding device, it can be used practically for any type of yarn feeding device, even if the yarn feeding device as used has no constructional preparation or adaptation of its control system for a transmission of a speed signal to the exterior. By this the production costs of the yarn feeding device can be reduced. Any type of accessory device of the kind as mentioned above can be combined later with yarn feeding devices already in use. Surprisingly simple, at least an outwardly leaking part of a rotating magnetic field can be detected from the exterior of a yarn feeding device which has an interior component which is rotatably driven by an electric motor in a controlled fashion. Said leaking part of the rotating magnetic field is available at the mounting location of the sensor but is not used at this location for the function of the yarn feeding device. It is only necessary to select the mounting location of the sensor such that the sensor is able to reliably detect the rotation of the magnetic field. On the basis of said leaking part of the magnetic field, the sensor generates a signal representing the rotational speed of the component within the yarn feeding device. Normally, the housings of yarn feeding devices are not sufficient to shield or suppress the leakage of a part of the magnetic field, which leaking part suffices for detection and generation of the speed signal. Sensors detecting the leakage or wasted part of the magnetic field allow expansion of the range of applications for yarn feeding devices and for accessory devices being driven in dependence from the rotational speed of the yarn feeding devices, since thanks to the sensor, such accessory devices can even be applied on yarn feeding devices which per se are not prepared for a speed depending co-action with any accessory devices.

The signal is transmitted to the accessory device from the signal exit port of the sensor, preferably to the control unit of the accessory device. The signal then is used in the accessory device depending on the control routine of the accessory device. In any case it is assured that the speed signal is available when necessary without interfering with the control system or the drive means of the yarn feeding device by a prefabricated and/or disturbance-sensitive galvanic connection. Provided that the sensor is equipped with a signal cable and a detachable connector, the sensor can be combined with any type of accessory device needing said speed signal. Accessory devices may be used with the sensor which already are prepared for a galvanic connection with the control system or the drive means of the yarn feeding device.

The sensor can include its own power supply and is independent from the yarn feeding device, and optionally, also from the accessory device.

The sensor can be supplied with operational power either from the accessory device or independently of the accessory device from a power supply box of the yarn feeding device. Such box is usually equipped with spare connection ports or connection ports thereon can be provided with minimum effort. Furthermore, the sensor may be connected to a completely independent power supply or may be provided with a battery inside such that the sensor remains completely independent from any other power source.

The sensor can be used at least to assist in the control of a yarn impregnation device, e.g., a yarn oiler, which is provided along the yarn path in order to apply an impregnation substance such as oil or wax on the yarn. This impregnation is important for certain yarn qualities in view of a proper processing of the yarn.

The accessory device in one embodiment is a slip conveyor having at least one friction roll driven in dependence from the rotational speed in the yarn feeding device or from the yarn speed. Said slip conveyor either assists in withdrawing the yarn at a withdrawal side from the yarn feeding device or in conveying the yarn at the inlet side towards the yarn feeding device.

The accessory device in another embodiment is a controlled yarn brake, the braking effect of which is variable depending upon the yarn speed. Said controlled yarn brake may be provided at the inlet side and/or at the withdrawal side of the yarn feeding device.

The accessory device using the speed signal of the sensor is a rotational drive of a storage bobbin carrying the yarn for the yarn feeding device. The purpose of said rotational drive is to reduce or eliminate the twist or drill of the yarn normally resulting when pulling off yarn from a stationary storage bobbin. This can be important for high fabric quality when weaving Lurex or band yarns.

The sensor is mounted at its mounting location by the carrier means of the yarn impregnation device, preferably at or close to the inlet side housing end wall of the yarn feeding device. At this location, particularly in the area of the inlet eyelet of the yarn feeding device, e.g. the rotation of the magnetic field of the drive motor is easily detectable by the sensor. The sensor may be integrated per se into the carrier means. Alternatively, the sensor may be designed with its own fixing means, or the carrier means may be provided with a fixing means enabling simple positioning of the sensor.

The speed signal generated in the sensor is transmitted to the control unit of the electric motor of the treatment element of the yarn impregnation device. If the signal exit port of the sensor is permanently connected with the control unit, the sensor so to speak is an integrated part of a structural unit consisting of the yarn impregnation device, the carrier means and the sensor. In case that the signal exit port is releasably connected to the control unit, the sensor also may be selectively used with other types of accessory devices. It then is even possible to connect the yarn impregnation device in a conventional galvanic manner without the sensor to the control system of a yarn feeding device accordingly prepared for the galvanic co-action with the yarn impregnation device. One type of an accessory device may be selectively combined with different yarn feeding devices.

A receiving socket for the sensor is formed at the housing of the yarn feeding device, e.g., an insertion opening, a threaded bore or a hang-in hole. Said receiving socket can readily be formed with tools available at the working location of the yarn processing systems, e.g. in a weaving mill. It is also possible to form a receiving socket like an insertion opening, a bayonet socket, a screw-in socket or the like in the yarn feeding device housing during manufacturing of the yarn feeding device, however, without using any galvanic connection to the control system or the drive means of the yarn feeding device.

The accessory device is located separately and remotely from said yarn feeding device, while the sensor is located at or close to the yarn feeding device. Signal transmission takes place via a cable. This allows positioning of the accessory device arbitrarily at a location where it optimally fulfills its purpose.

The part of the magnetic field used for the speed detection is a leaking out part of a driving, controlling or monitoring magnetic field of the drive motor, i.e., of an electric motor of the yarn feeding device. The rotation of the magnetic field is representing the momentary rotational speed of all components in the yarn feeding device driven by said electric motor, or the rotational speed of the motor itself, or even the momentary yarn speed, respectively.

The sensor for deriving the speed signal detects the rotation of a part of a magnetic field, which part is not used for the function of the yarn feeding device at the mounting location of the sensor. Said magnetic field originates from a permanent magnet belonging to a rotation detector which is integrated into the yarn feeding device. Conventionally, the winding element is defined by an outwardly protruding winding tube and/or a winding disk on the drive shaft and is made of non-magnetic material. The rotation detector integrated into the yarn feeding device (e.g. U.S. Pat. No. 4,715,411) consists of the permanent magnet provided at the winding element, and of a stationarily positioned detecting element like a Hall element. The rotational movement of the magnetic field generated by the permanent magnet during operation of the yarn feeding device is detectable by the sensor even when it is galvanically separated from the control system and the drive means of the yarn feeding device. For said purpose the sensor ought to be situated close to said winding element at the stationary housing of the yarn feeding device.

The sensor is provided with a probe-shaped housing for the pick-up head apt to detect rotating magnetic fields and/or magnetic field variations of rotating magnetic fields without galvanic connection. The housing of the sensor is to be positioned where at least a part of a magnetic field is leaking outwardly to the pick-up head, said part not being used for the function of the yarn feeding device at the mounting location of the sensor. It is possible to provide a fixation means at the sensor. In order to gain a forceful and clear speed signal and to achieve a completely independent operation of the sensor, amplification and evaluation circuitry might be useful if received in the sensor housing.

The sensor easily may be glued to the housing at the mounting location.

The sensor can also be mounted with a fixing band at the housing of the yarn feeding device.

At least one of the existing protrusions or cooling fins of the housing of the yarn feeding device is used to mount the sensor at its mounting location by means of a clamp engaging at said protrusion or cooling fin, respectively.

The speed signal generated by the sensor without a galvanic connection with the control system or the drive means of the yarn feeding device is used in the accessory device to control the movement of a part thereof depending upon the rotational speed in the yarn feeding device. It is possible to control said part permanently or only in predetermined operational phases according to said rotational speed. The part may then be controlled in direct or indirect proportion to the rotational speed. In a yarn impregnation device with a rotating treatment element, the speed signal is used to vary the rotational speed of the treatment element. In a controlled yarn brake said speed signal is used to vary the braking or tensioning effect on the yarn by means of at least one movable braking element. In a drive for a storage bobbin, said speed signal is used to rotate said bobbin according to the rotational speed in the yarn feeding device such that the yarn leaving the bobbin receives only a reduced drill or no drill or twist at all. In a slip conveyor, a slip element is driven accordingly to adjust the slip in the yarn conveying direction corresponding to the momentary yarn speed.

BRIEF DESCRIPTION OF THE DRAWINGS

Embodiments of the invention will be explained with reference to the drawings, in which.

DETAILED DESCRIPTION

Figure 1:
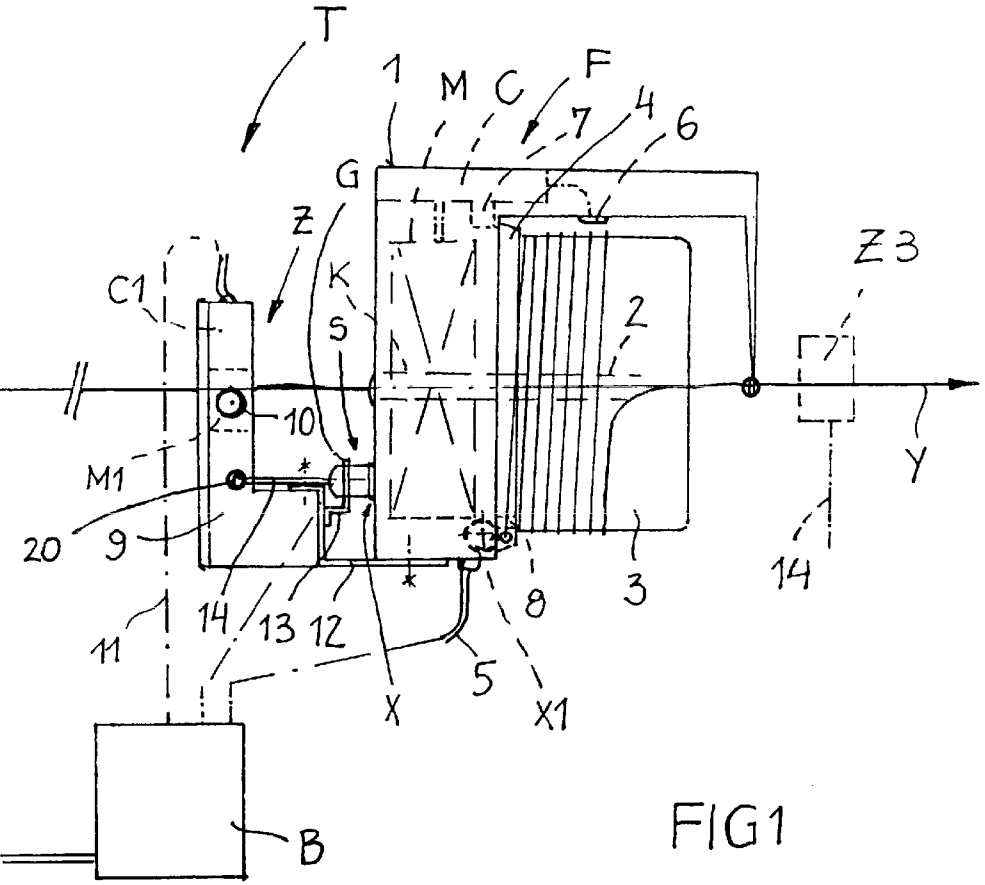
FIG. 1 is a schematic side view of a yarn processing system.

A yarn processing system T in FIG. 1 comprises as a main component a yarn feeding device F, namely and as shown, a weft yarn storing and feeding device for a weaving machine. Instead of a weft yarn storing and feeding device, said yarn processing system T could include a yarn storing and feeding device for a knitting machine, e.g. with a rotating storage drum (not shown). In the path of a yarn Y processed by the yarn feeding device F for downstream consumption, at least one accessory device Z, Z1, Z2, Z3 is provided co-acting with the yarn feeding device F such that the accessory device is mechanically acting upon the yarn Y depending upon the linear yarn speed or the rotational speed of at least one component rotating inside the yarn feeding device F.

The accessory device Z may, e.g. be a yarn impregnation device 9, i.e. a so-called yarn oiler, applying a substance (oil or wax) onto the yarn Y in order to facilitate its further processing in the yarn feeding device and/or in the textile machine (weaving or knitting machine) consuming said yarn. Accessory device Z in FIG. 1 is mounted to a housing 1 of the yarn feeding device F. It is, however, possible to instead position the respective accessory device, i.e. even the yarn impregnation device Z, elsewhere along the yarn path and separated or remote from the yarn feeding device F as shown in dotted lines for e.g. accessory device Z2, between the yarn feeding device F and a yarn storage bobbin 15. Alternatively or additively to the yarn impregnation device 9, said accessory device Z2 could be a controlled yarn brake or a controlled yarn tensioner located between the storage bobbin 15 and the yarn feeding device. Accessory device Z mounted to housing 1 instead of said yarn impregnation device 9 may be a controlled yarn input brake. Accessory device Z3 shown in dotted lines could be a controlled yarn brake at the exit or output side of the yarn feeding device. Also one accessory device (e.g. Z, Z2 or Z3) could be a controlled slip conveyor withdrawing the yarn at the output side of the yarn feeding device F or conveying the yarn to the inlet side with slip by means of at least one driven friction roll. Accessory device Z1 shown in dotted lines at storage bobbin 15 may be a rotation drive for the storage bobbin 15 to drive the latter with a variable rotational speed such that during withdrawal of the yarn Y from the storage bobbin 15 no or reduced twist occurs. In brief, in the yarn processing system T of FIG. 1, only one accessory device or several accessory devices may be used.

The accessory device as used includes a movable part, the movement of which at least temporarily must take into consideration the rotational speed in the yarn feeding device F or the linear speed of the yarn Y. For this reason, a speed signal generated by an exterior located electronic sensor S is transmitted for control purposes to the accessory device. In the yarn processing system T, a common sensor S could be used for all respective accessory devices, or a number of sensors S corresponding to the number of accessory devices may be provided.

Yarn feeding device F is receiving in housing 1 an electric motor M driving a drive shaft 2 of a winding element 4. Yarn feeding device F has a storage drum 3 for storing the yarn Y in windings from which windings the consuming textile machine (a weaving or a knitting machine) is withdrawing the yarn axially or tangentially. The electric motor M of the yarn feeding device F is connected to a control system C to which signals of a schematically indicated yarn sensor device 6 may be input for control purposes. Housing 1 may include a rotation detector integrated into the yarn feeding device F in signal transmitting connection with control system C, as indicated. Said rotation detector consists of a permanent magnet 8 secured to the winding element 4, and of a stationary detecting element 7 associated and aligned with the passage path of said permanent magnet 8. winding element 4 is a disk made of non-magnetic material and rotates with drive shaft 2. Permanent magnet 8 is fixed to said winding disk at an appropriate location. Yarn feeding device F is supplied with operation and control power via a cable 5 connected to a power supply box B, to which further yarn processing systems of the textile machine can be connected as well (not shown).

The yarn impregnation device 9, e.g. constituting said accessory device Z, comprises at least one treatment element 10 (e.g. an application roll) rotatably driven by an electric motor M1. Treatment element 10 receives an impregnating substance, e.g. from a not shown wick, and transfers said substance onto yarn Y while the latter is guided through the yarn impregnation device 9. An electronic control unit C1 is provided in said yarn impregnation device 9 for electronic motor M1. Operation and control power for the yarn impregnation device 9 is supplied via a cable 11 either from its own power source or as shown from power supply box B.

The accessory device C or the yarn impregnation device 9, respectively, is fixed by a carrier means 12, e.g. by at least one holding bracket to housing 1, either at the lower side of housing 1 or at an inlet side end wall of housing 1. In said inlet side end wall of housing 1, conventional fixation bores for accessory devices of different kinds are pre-formed. Sensor S is integrated into carrier means 12 such that it contacts the housing end wall or is located adjacent to it, particularly at a mounting location X. During rotation of at least a component K of the yarn feeding device F (e.g. of electric motor M), the sensor at mounting location X detects at least a part of a rotating magnetic field which leaks through housing 1. Sensor S is incorporated into carrier means 12 either by its own fixation part 13 or by a fixation means G. Said rotating magnetic field may be the driving, the controlling or the supervising magnetic field of the electric motor M, respectively.

The sensor S is an electronic sensor deriving a signal from the rotation of the magnetic field or the detected part of said magnetic field without having galvanic connection to the control system C or the electric drive motor M of the yarn feeding device F. Said signal is representing the rotational speed in the yarn feeding device F and indirectly the linear yarn speed as well, since the yarn Y is wound onto storage drum 3 by the rotation of winding element 4.

In the embodiment shown, the sensor S is connected via a signal transmitting and, optionally, a power supply cable 14 to a connection port 20 of accessory device Z. Connection port 20 can comprise a plug such that the connection is releasable. Alternatively, sensor S can be connected to its own power supply, e.g. to the power supply box B or even to a completely separated power source. As an example, a dash-dotted line indicates a connection between sensor S and power supply box B. Instead, sensor S could be equipped with its own permanent power source, e.g. a battery, in order to operate the sensor S completely independently. Since here accessory device Z already is supplied with power via a cable 11, it is suitable to supply sensor S also directly with operational power from accessory device C, e.g. via cable 14. The respective accessory device Z, Z1, Z2 and Z3 receives the speed signal on signal cable 14.

In FIG. 1 in dotted lines, another mounting location X1 for such a sensor S is shown. Said location X1 is situated close to winding element 4 such that sensor S positioned at X1 at housing 1 is detecting the rotation of the magnetic field to generate the necessary speed signal without the galvanic connection to the control system C or to drive motor M of the yarn feeding device F. Said leaking part at location X1 of the magnetic field otherwise is not used for the operation of the yarn feeding device F.

Sensor S may—as explained—be positioned with its fixation means G at the selected mounting location X or X1. Alternatively, it is possible for this purpose to form a receiving socket for sensor S in housing 1 of the yarn feeding device F, e.g. an insertion bore socket, a threaded bore or a hang-in opening. It is even possible to beforehand manufacture the housing 1 of the yarn feeding device F with an insertion socket, a threaded socket, a bayonet socket or a hang-in opening for sensor S or for the fixation means G of sensor S.

Figure 2:
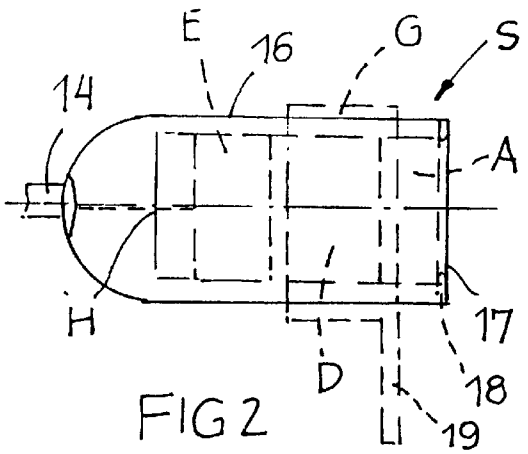
FIG. 2 is an enlarged side view of a sensor detecting the rotational speed in a yarn feeding device or the linear speed of the yarn entering the yarn feeding device.

The electronic sensor S in FIG. 2 has a probe-shaped housing 16 receiving a pick-up head A, e.g. in the region of a housing end portion 17. Optionally, at housing end portion 17, an elastic layer 18 may be provided thereby avoiding a direct hard contact between housing 16 and housing 1 (FIG. 1). The fixation means G of sensor S in FIG. 2 here is collar-like and is secured to housing 16, preferably in an axially displaceable fashion, and comprises a fixation part 19 which might be equipped with different fixation points or fixation means in order to position the sensor S at the intended mounting location X or X1 or at another not shown mounting location. An amplifying circuitry D and a evaluation circuitry E can be integrated into housing 16. The speed signal is output at signal exit port H of sensor S to be transmitted via cable 14.

As a fixation means G for sensor S, a plastic, rubber or foam material body on housing 16 could be used having a permanent adhesive coating such that sensor S simply can be glued to housing 1. Alternatively, sensor S could be secured by means of a tensioning band extending around housing 1 or around a part of housing 1 of the yarn feeding device F. As a further alternative, a spring loaded clamp could constitute said fixation means G. Said clamp could be secured to an existing protrusion or a cooling fin of housing 1. In case that no accessory device Z is mounted directly to housing 1, carrier means 12 or a similar carrier means could be used to solely position sensor S at the intended mounting location X or X1.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A yarn processing system comprising a yarn feeding device and at least one accessory device associated with said yarn feeding device, said yarn feeding device including at least one component driven in a controlled fashion by an electric motor, said accessory device having at least one movable part which is driven through use of a signal representing the rotational speed of said component of said yarn feeding device, said signal being generated in an electronic sensor responsive to at least a portion of a rotating magnetic field, said sensor being galvanically separated from a control system or the electric motor of said yarn feeding device and structurally independent from said yarn feeding device, said sensor being positioned at or close to a housing of said yarn feeding device at an exterior mounting location where at least a portion of a magnetic field which rotates with said component within said yarn feeding device leaks through said housing and is detectable, said sensor detecting a rotational speed of said component based upon detection of said portion of the magnetic field, said portion of said magnetic field being otherwise unused in said yarn feeding device at said mounting location of said sensor.

2. The yarn processing system according to claim 1 wherein said sensor generates a speed signal representing the rotational speed of said component based upon detection of said portion of said magnetic field.

3. The yarn processing system according to claim 2 wherein said sensor has at least one signal exit port connectable to said accessory device by a cable and a releasable connector.

4. The yarn processing system according to claim 1 wherein said sensor is connected for its power supply to said accessory device, or to a power supply box of said yarn feeding device, or to its own power supply source.

5. The yarn processing system according to claim 1 wherein said accessory device is a controlled yarn impregnation device provided along the yarn path of the yarn.

6. The yarn processing system according to claim 1 wherein said accessory device is a controlled slip conveyor associated with the yarn along the yarn path.

7. The yarn processing system according to claim 6 wherein said controlled slip conveyor is mounted at the yarn feeding device at its inlet or outlet side.

8. The yarn processing system according to claim 1 wherein said accessory device is a controlled yarn brake associated with the yarn along the yarn path.

9. The yarn processing system according to claim 8 wherein said controlled yarn brake is mounted adjacent at least one of the inlet side and the outlet side of the yarn feeding device.

10. The yarn processing system according to claim 1 wherein said accessory device is a drive of a rotatably driven storage bobbin carrying yarn which is supplied to said yarn feeding device.

11. The yarn processing system according to claim 5 wherein said yarn impregnation device is mounted by a carrier to the yarn feeding device and said sensor is secured to said carrier, said carrier being mounted to said yarn feeding device and the sensor being positioned at the mounting location at or close to an inlet side housing end wall of the yarn feeding device.

12. The yarn processing system according to claim 11 wherein said yarn impregnation device includes at least one treatment element and a control unit for an electric motor which drives said treatment element, said control unit being permanently or releasably connected to a signal exit port of the sensor.

13. The yarn processing system according to claim 1 wherein a receiving socket for said sensor is provided at said mounting location at the housing of the yarn feeding device, said receiving socket comprising one of: an insertion socket; a threaded bore; and a hang-in opening.

14. The yarn processing system according to claim 1 wherein said portion of the magnetic field originates from a driving, a controlling or a monitoring magnetic field of the electric motor of said yarn feeding device.

15. The yarn processing system according to claim 1 wherein said portion of the magnetic field originates from a permanent magnet situated on a rotatable winding element of the yarn feeding device, said permanent magnet being part of a rotation detector integrated into said yarn feeding device.

16. An electronic sensor for generating a signal representing the rotational speed of a rotating component of a yarn feeding device which is driven in a controlled fashion by an electric motor received within a housing of the yarn feeding device, said sensor being galvanically separated from a control system or the electric motor of the yarn feeding device and being mounted at or close to the housing of the yarn feeding device at an exterior mounting location, said sensor comprising a pick-up head responsive to at least part of a magnetic field rotating with the component within the yarn feeding device and leaking through the housing, the part being unused for the functioning of the yarn feeding device at the mounting location of said sensor.

17. The electronic sensor according to claim 16 wherein said sensor comprises a probe-shaped housing which receives said pick-up head and a fixation device for positioning said sensor at the mounting location, and said sensor housing includes amplification and evaluation circuitry.

18. The electronic sensor according to claim 17 wherein said fixation device of said sensor housing is defined by at least one body having an adhesive coating for securing said sensor to the housing of the yarn feeding device, said body being constructed of one of: plastic; rubber; and foam material.

19. The electronic sensor according to claim 17 wherein said fixation device comprises a tensioning band.

20. The electronic sensor according to claim 16 wherein said fixation device includes at least one spring-loaded clamp for fixing the sensor at a protrusion of the housing or a cooling fin of the housing.

* * * * *